United States Patent [19]

Reese

[11] 4,097,004

[45] Jun. 27, 1978

[54] METHOD AND APPARATUS FOR UNWINDING ROVING PACKAGES FROM THE INSIDE

[75] Inventor: Walter J. Reese, North Huntington, Pa.

[73] Assignee: PPG Industries, Inc., Pittsburgh, Pa.

[21] Appl. No.: 794,592

[22] Filed: May 6, 1977

[51] Int. Cl.[2] ..... B65H 49/36

[52] U.S. Cl. ..... 242/129.72; 242/141

[58] Field of Search ..... 242/128, 129, 129.5, 242/129.6, 129.62, 129.72, 141; 206/391-394; 229/51 R

[56] References Cited

U.S. PATENT DOCUMENTS

| | | | |
|---|---|---|---|
| 864,342 | 8/1907 | Smith | 242/128 |
| 2,249,680 | 7/1941 | Bishop | 242/141 |
| 2,620,998 | 12/1952 | Te Strake | 242/128 |
| 2,630,280 | 3/1953 | Wedler | 242/128 |
| 2,654,551 | 10/1953 | Te Strake | 242/128 |
| 2,858,088 | 10/1958 | Bookout | 242/129 |
| 3,011,736 | 12/1961 | Furst et al. | 242/128 |
| 3,028,117 | 4/1962 | Shepley | 242/129 |
| 3,082,973 | 3/1963 | Bittman | 242/129 |
| 3,112,899 | 12/1963 | Hosbein | 242/128 |
| 3,193,179 | 7/1965 | Bogren | 229/51 |
| 3,339,862 | 9/1967 | Parker | 242/128 |
| 3,520,491 | 7/1970 | Hollack | 242/129.8 |
| 3,545,698 | 12/1970 | Medney | 242/128 |
| 3,983,997 | 10/1976 | Warshaw | 206/389 |

*Primary Examiner*—Leonard D. Christian

*Attorney, Agent, or Firm*—Alan T. McDonald; John E. Curley

[57] ABSTRACT

A method and apparatus are disclosed for the continuous unwinding of a plurality of packages of strand material in succession without stoppages between packages wherein the strand material is pulled from the inside of the packages. The method involves isolating the outside end of the strand of a first package so that this end cannot become entangled with the strand being withdrawn from the inside. The outside end of the strand of the first package is connected to the inside end of the strand of a second package, and the package is controlled as it is being unwound so that the package will not tend to lift or collapse and thus become entangled with itself near the end of its pay-out to thereby provide a complete pay-out of strand for each package and provide transfer from one package to another. The steps are repeated for each subsequent package. Suitable apparatus for accomplishing this result is also described.

5 Claims, 3 Drawing Figures

Fig. 1
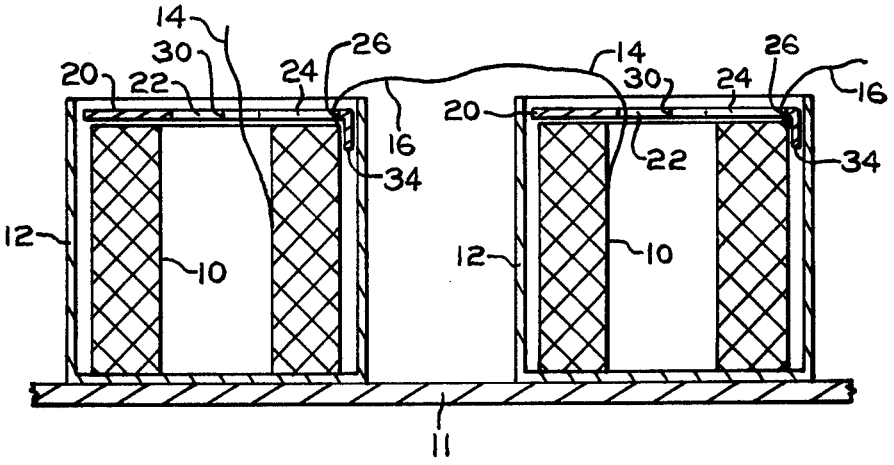
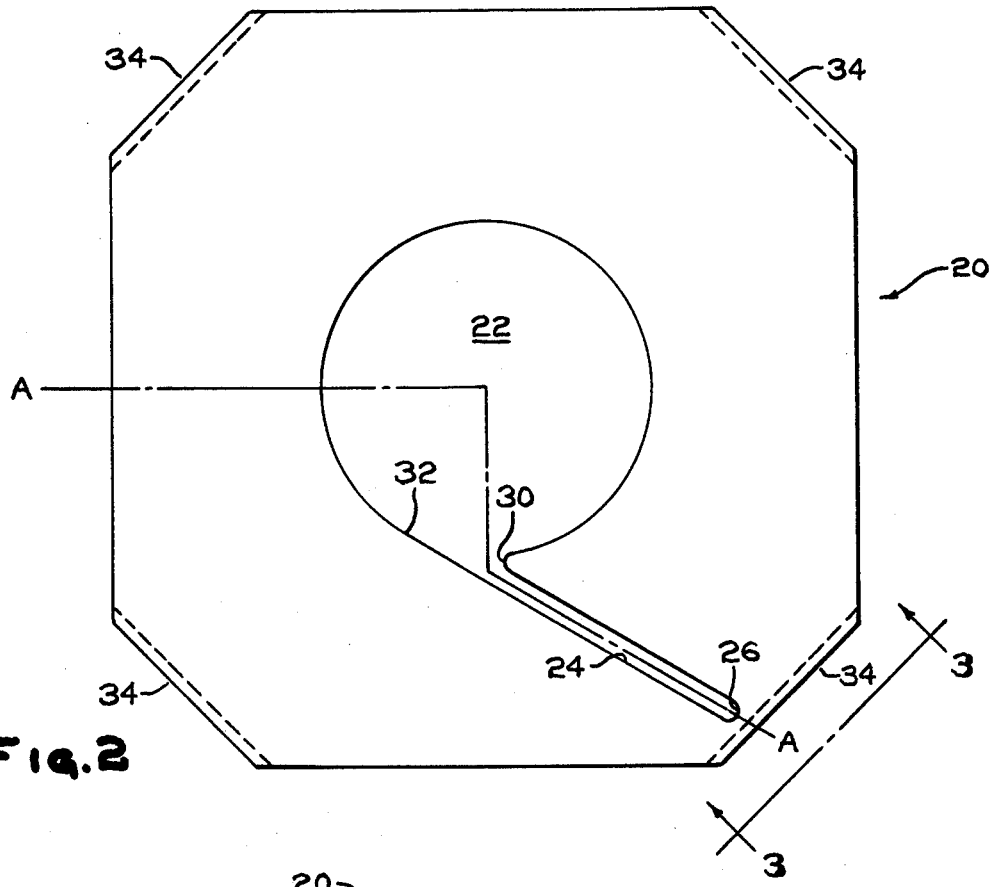
Fig. 2
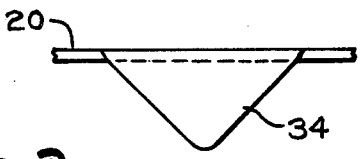
Fig. 3

METHOD AND APPARATUS FOR UNWINDING ROVING PACKAGES FROM THE INSIDE

BACKGROUND OF THE INVENTION

Strand materials, such as glass fiber strands, are often employed in the reinforcement of resinous materials and in the manufacture of woven fabrics. Thus, continuous glass strands may be fed to a roving gun where they are chopped into particulate strands, mixed with resin and sprayed onto a mold or the continuous strands can be passed through a bath of resin and pulled through a dye, as well as many other like plastic reinforcement operations. Alternatively, the strands may be woven in a loom into a fabric or used to reinforce paper, tapes, and the like.

In many of these operations, the continuous strand material employed is in the form of rovings, which comprise a plurality of parallel wound strands. The number of strands in a roving can range from 2 to 60 or more. Each strand, in turn, may comprise from about 200 to about 2,000 or move individual filaments. A psuedo-roving or single end roving can also be produced wherein a single strand is formed comprising a number of filaments equivalent to that of a multi-end roving and similarly wound.

In either case, the rovings or psuedo-rovings are supplied as cylindrical packages having approximately square edges. These packages are designed such that the strand material is unwound from the inside of the package.

Several problems arise from the unwinding of strands from the inside of the package. First, as the package is unwound, the shell of the package becomes thinner and thinner. This can eventually lead to the package becoming so unstable that the walls may finally collapse, with the remaining strands becoming entangled with themselves, with the result that the balance of the strand must be discarded. Often, if the walls have not collapsed, the remaining package becomes so light that pulling the strand from the inside lifts the package entirely, rather than unraveling the end of the strand from the package, due to the inability of the light package to overcome the adhesive forces between the strands, which normally have binders and/or sizes coated thereon. This again leads to tangles and requires discard of the balance of the package.

in U.S. Pat. No. 2,630,280 an apparatus is described to eliminate the aforementioned problems. A square end roving package is located within a chamber. On top of the roving package is a washer-like member which acts as a strand guide and as a restraint of vertical movement of the package. Collapse of the package is prevented by creating a vacuum in the chamber in which the roving package is located to thus force the walls of the roving package against the walls of the chamber. While this apparatus has been satisfactory, the apparatus requires a vacuum pump and other cumbersome apparatus. It is, therefore, an object of the present invention to provide a method and apparatus for providing successful payout of a complete roving package without the necessity of cumbersome mechanical apparatus.

In operations such as gun roving spraying, pultrusion, fabric weaving, paper reinforcement, and the like, it is desired by the manufacturer that the operation be maintained as a continuous process. Thus, it is desired that when a strand package has been completely exhausted, transfer to another forming package be continuous. This requires that the outside end of strand of the package being unwound be connected to the inside end of strand of the next package. While the connection between strand packages is simple enough to accomplish, difficulty has arisen using washer-like strand guides such as that described in U.S. Pat. No. 2,630,280, since, if both the inner and outer ends of the package are maintained in the central opening thereof, as the strand travels around the guide, abrasion between the strand being unwound and the outer end of the strand occurs, resulting in fraying and breakage of the outer strand end. It is thus an object of the present invention to provide an apparatus which isolates the outer strand end of the strand package from the strand which is being unwound from the package to thereby eliminate the aforementioned abrasion problem, while still allowing continuous transfer from one package to another without stoppage of the manufacturing operation.

THE PRESENT INVENTION

By means of the present invention, all of these desired results are obtained. The method of the present invention involves guiding the strand material as it is unwound, isolating the outer strand end of the strand package from the strands being unwound, connecting the outer strand end of the strand package to the inner strand end of a subsequent package and restraining vertical motion of the package as the strand is being unwound. The apparatus for accomplishing this result includes a novel strand guide of a weight sufficient to restrict the strand package during unwinding. The guide includes an opening through which the strand can be unwound from the inside and a slot extending from the opening into which the outer strand end of the package is located and isolated from the balance of the package. The guide also includes one or more legs which maintain the strand guide over the package, when the package has reached minimal height, so that the strand guide will not crush the last remaining strands of the package when the package is nearly completely unwound and thus prevent tangling of these final strands. Employment of a pair of the novel strand guides of the present invention allows a plastics or paper reinforcement manufacturer, weaver or other manufacturer to transfer from one package to another and maintain continuous production from his operation almost indefinitely.

BRIEF DESCRIPTION OF THE DRAWINGS

The present invention will be more completely described with reference to the drawings in which:

FIG. 1 is a cross-sectional diagrammatic representation of the unwinding of strand packages from the inside according to the method of the present invention, with the strand guide being illustrated through section A—A of FIG. 2;

FIG. 2 is a top elevational view of the novel strand guide employed in the present invention; and FIG. 3 illustrates one of the legs employed in one embodiment of the strand guide of the present invention.

DETAILED DESCRIPTION OF THE DRAWINGS

Turning now to the figures, in FIG. 1 a pair of strand packages 10 are illustrated within containers 12 resting on surface 11, such as a floor, table or the like. While the packages 10 can be unwound successfully without being located within containers 12, it is preferable that the packages 10 be maintained in these containers, which are typically the shipping containers for the packages 10. Each of the packages 10 has an inner strand end 14 and an outer strand end 16 of strand or roving. The inner strand ends 14 of the packages 10 are located within openings 22 of the strand guides 20. The outer ends 16 of the packages 10 are locatd within slots 24 of the strand guides 20.

The opening 22 and slot 24 in the strand guide 20 can best be seen in FIG. 2. The guide 20 may be round, square or any other desired shape. Its length and width are sized so that the guide is slightly larger than the diameter of the strand package 10 and slightly smaller than the dimensions of the strand package container 12 so that the guide 20 may travel vertically within the container 12 over the packages 10. The opening 22 is preferably slightly smaller than the inner diameter of the strand on the strand package 10 prior to any removal of strand therefrom, to limit abrasion of the strand against the package 10 as it is being unwound. The opening is preferably round, oval or the like to provide a smooth surface for the strand. The opening 22 may be beveled to again provide a smooth running surface.

The slot 24 extends from the opening 22. The slot 24 may be at any desired angle to the opening 22 from perpendicular to the opening 22 to tangent to the opening 22. If the slot 24 is other than perpendicular to the opening 22, the angle of the slot 24 is preferably located extending in the direction such that the strand end 14, which is running around the opening 22, runs in the direction opposite to the slot 24, i.e., the strand end 14 runs from point 30 to point 32. It is known that a roving package will unwind in a clockwise direction if standing on one end and pulled through the central opening of the package 10 and will unwind in a counterclockwise direction if standing on its other end and pulled through the central opening of the strand package 10. Thus, the package 10 is located within the container 12 such that the direction of strand travel will oppose the direction of the slot 24, as previously mentioned. Thus, the guide 20 as illustrated in FIG. 2 is designed for clockwise unwinding of strand. This counterdirectional travel of the strand end 14 to the direction of the slot 24 removes any possibility of the strand end 14 slipping into the slot 24 as it is being unwound.

Located within the slot 24 is strand end 16, which is the outer end of the strand package 10. This strand end 16 is connected to the inner end 14 of a subsequent package 10. The slot 24 preferably has a length such that its outermost extension 26 is located slightly beyond the outer diameter of the package 10. This effectively isolates outer strand end 16 from the balance of the package 10 and allows complete unwinding of the entire package 10 without abrasion of the strand end 16.

In operation, as the strand end 14 is continuously withdrawn from the package 10, the inner diameter of the package 10 expands. Eventually, the package 10 becomes light enough so that the package 10 attempts to lift, rather than pay-out, due to the adhesive forces previously mentioned. However, the weight of the guide member 20 on the package 10 is sufficient to overcome these adhesive forces and eliminate this lifting problem. Near the outer end 16 of the package 10, the package will also decrease in thickness and height. The guide 20 will lower itself onto the remainder of the package. This prevents the walls of the package 10 from collapsing. It is at this point that the importance of the leg or legs 34 becomes evident. As the guide 20 lowers, eventually, it could lie flat on top of the few remaining strands near the outer end 16 of the package 10, crushing these strands and causing entanglement and breakout. However, by employing the leg or legs 34 on the strand guide 20, the last remaining strands of the package 10 will rise slightly but only to the height of the legs 34 and will pay-out completely. As illustrated, the strand guide includes a plurality of legs 34. Obviously, a single leg or protrusion extending completely around the outer edge of the guide may also be employed.

The final pay-out of the outer strand end 16 arises at the end of the package 10. The strand end 14 will pay-out as previously mentioned, with the last strand entering the slot 24 and capturing the strand end 16. At this point, pay-out of strand end 14 from the next package 10 begins immediately without interruption. When pay-out of the next package 10 has begun, a subsequent package 10 can be connected to it by employing the guide 20 from the first package 10 which has been completed. Thus, employment of a pair of strand guides 20 of the present invention allows continuous pay-out from a plurality of strand packages 10 without interruption, almost indefinitely.

From the foregoing, it is obvious that the present invention provides a method and apparatus for unwinding strand material from the inside of a plurality of strand packages continuously which is both simple in construction and operation.

While the invention has been described with respect to certain specific embodiments thereof, it is not intended to be so limited thereby, except insofar as in the accompanying claims.

I claim:

1. Apparatus for unwinding strand material from the inside of a package of strand material comprising an axially movable guide means having an opening therein through which said strand material is unwound, a slot connected to said opening within which the outside end of the package is isolated from the balance of the package and one or more legs upon which said guide means may stand, said guide means being sufficient in weight to restrain lifting of the package during unwinding of said package and said legs being sufficient in height to avoid tangling of the package during the unwinding of the last portions of said package.

2. The apparatus of claim 1 wherein said opening is smaller than the inner diameter of the strand package.

3. The apparatus of claim 1 wherein said slot extends beyond the outer diameter of the strand package.

4. The apparatus of claim 1 wherein said slot extends at any angle from tangent to said opening to perpendicular to said opening.

5. The apparatus of claim 1 wherein said opening is beveled.

* * * * *